US006129325A

United States Patent [19]

Niklas

[11] Patent Number: 6,129,325

[45] Date of Patent: Oct. 10, 2000

[54] CHRISTMAS TREE STAND

[76] Inventor: Hermann Niklas, Johann-Gruber-Strasse 14, D-93491, Stamsried, Germany

[21] Appl. No.: 09/155,981

[22] PCT Filed: Apr. 18, 1997

[86] PCT No.: PCT/EP97/01975

§ 371 Date: Oct. 9, 1998

§ 102(e) Date: Oct. 9, 1998

[87] PCT Pub. No.: WO97/39666

PCT Pub. Date: Oct. 30, 1997

[30] Foreign Application Priority Data

Apr. 23, 1996 [DE] Germany ..... 196 16 209

[51] Int. Cl.[7] ..... F16M 13/00; A47G 33/12

[52] U.S. Cl. ..... 248/523; 248/516; 248/524; 47/40.5

[58] Field of Search ..... 248/523, 524, 248/511, 519; 47/40.5

[56] References Cited

U.S. PATENT DOCUMENTS

| | | | |
|---|---|---|---|
| 3,298,643 | 1/1967 | Taylor | 248/523 X |
| 5,535,977 | 7/1996 | Poeshty | 248/524 |
| 5,707,037 | 1/1998 | Pastrick | 248/516 |
| 5,779,215 | 7/1998 | DeMasi | 248/523 |
| 5,791,626 | 8/1998 | Reese | 248/523 |

FOREIGN PATENT DOCUMENTS

| | | | |
|---|---|---|---|
| 6918214 | 5/1969 | Germany . | |
| 4118695 A1 | 12/1992 | Germany | A47G 29/00 |
| 4130965 | 12/1978 | U.S. | 47/40.5 |

*Primary Examiner*—Anita M. King
*Attorney, Agent, or Firm*—George T. Marcou; Kilpatrick Stockton LLP

[57] ABSTRACT

The novel Christmas tree stand has fixing elements (104) mounted in a housing. The fixing elements are moved, by supplying a pressure medium to annular bellows (16), from an opened position into a position to surround the trunk of the Christmas tree (17) from all sides. The fixing elements (104) are designed so as to ensure the automatic centering adjustment of the trunk. The expanding, flexible bellows (16) ensures that all of the fixing elements abut the trunk even if the cross-section is not circular and the bark is rough, thereby safeguarding the stability of the Christmas tree (17) in its upright position. The upper portion together with the base portion (101) forms the housing that is designed as a one-part moulding (103) in which an annular cup (105) supporting the bellows (16) and a receiving sleeve (106) holding the Christmas tree (17) by a centering mandrel (20) are installed and protected by a bottom plate. The receiving sleeve (106) is connected to a water reservoir via the supply line (119). The invention also comprises embodiments with two fixing systems for particularly high Christmas trees.

22 Claims, 5 Drawing Sheets

Fig.5
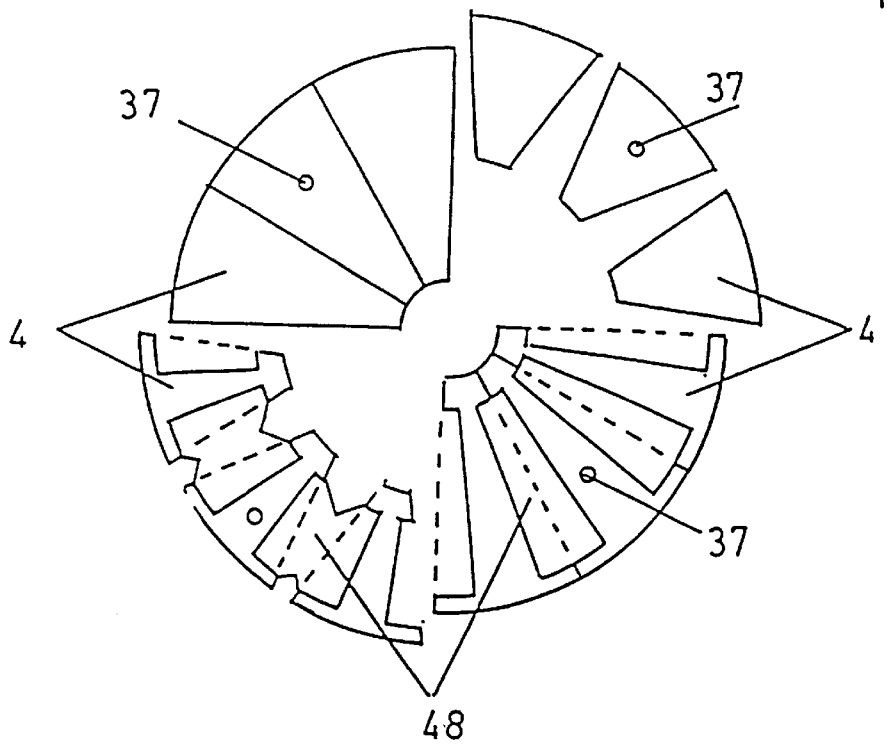
Fig.6
Fig.7
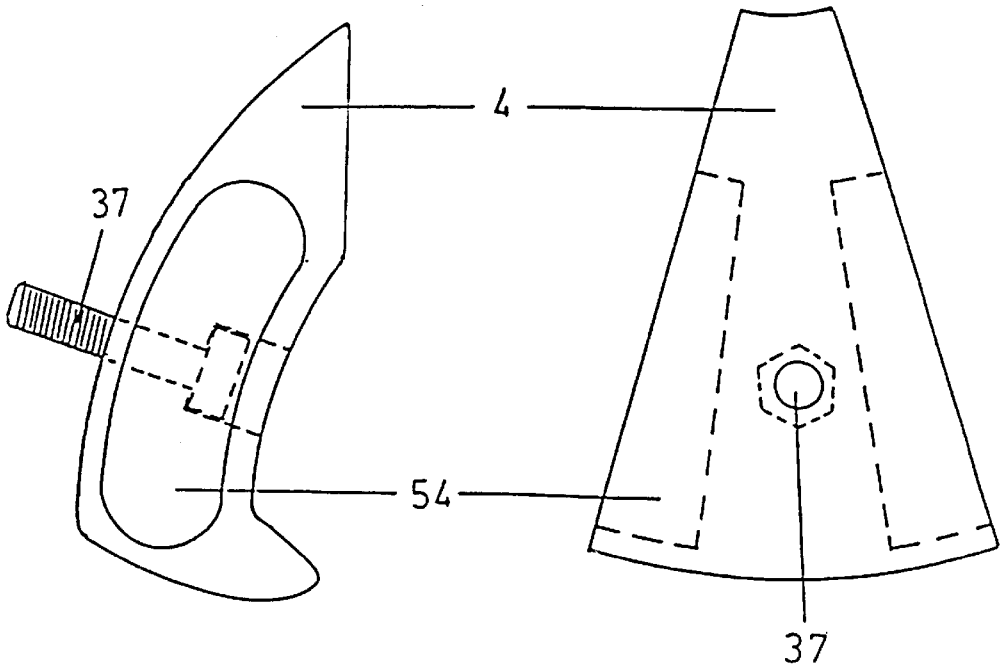

CHRISTMAS TREE STAND

BACKGROUND OF THE INVENTION

A variety of Christmas tree stands are known. In German utility model 6918214, for instance, a Christmas tree stand comprising a receiving sleeve having, at its upper end, circumferentially spaced apart axis-parallel resilient projections with inwardly pointing teeth is described. A clamping sleeve with an inwardly directed restriction, on unscrewing, urges the teeth inwardly via an inclined surface, thereby fixing the trunk in position. The receiving sleeve is inserted in a pot-shaped receptacle at the bottom of which a vertically disposed pointed pin ensures the fixation of the trunk end in position. Further-more, the receptacle can be filled with water in order to keep the Christmas tree fresh. With the Christmas tree stand just described the trunk is fixed in position—on unscrewing the clamping sleeve—by a particular movement of the teeth determined by the inclination of the inner surface of said sleeve. Accordingly, in the case of non-circular trunk cross-sections, which might moreover be deformed because of branch knots, a safe mounting of the Christmas tree is not possible. As a result of the absolutely inelastic transmission of the fixing forces from the clamping sleeve to the teeth via the inclined surface, settling or deformation phenomena at the points of contact with the trunk moreover directly lead to an inadmissible loosening which can only be eliminated by readjusting the clamping sleeve. Such deformation phenomena may be caused by lively children playing.

In DE 4118695 Al a device for holding one end of a rod-shaped structure which also serves to hold the trunk of a Christmas tree is indicated. It comprises a sleeve on the inner wall of which a body of a rubber-elastic material that can be filled up from outside is disposed. After having been filled up with a gaseous or liquid medium the body surrounds the trunk of the Christmas tree with its inside and holds it firm. The device has the disadvantage that the tree trunk to be fixed in position cannot be put in a vertical position. The same, a later inclination of the Christmas tree cannot be avoided as this device does not have any rigid and thus lockable elements. The Christmas tree to be fixed in position, when in an inclined position, cannot be brought into the desired vertical position by means of defined controlled forces and be permanently fixed there.

According to U.S. Pat. No. 4,130,965 a Christmas tree stand is known wherein arcuate adjusting elements guided in a hemispherical housing hold the trunk of the Christmas tree, the individual adjusting elements being guided in passageways provided in a sleeve mounted in the interior of the housing and being kept in their opening position with the aid of a spring, respectively. At the bottom of the sleeve a receiving element for guiding the trunk end is provided. The ends of the adjusting elements averted from the Christmas tree rest on base plates on the floor of the surrounding premises, thus forming the base portion of the known Christmas tree stand. On insertion of a Christmas tree into the known stand the weight of the tree, after deduction of the spring forces, generates the force by which the arcuate adjusting means press against the tree trunk and fix it in position.

With the known Christmas tree stands the uniform attack of the adjusting elements depends both on whether the floor of the premises where the tree is put up provides a plane surface, and on the trunk of the Christmas tree having an exactly cylindrical cross-section at the level of the points of attack. The latter criterion is not provided with the usual trees; in fact, branch ends remaining after sawing-off will have to be expected on the trunk. Furthermore, the known Christmas tree stand is not suited for putting up trees in streets or squares because of the unevenness of the ground. As a disadvantage it also has to be considered that slender, relatively light trees are fixed in position with less force than thick grown trees of the same height.

The problem underlying the invention is seen in the provision of a Christmas tree stand allowing the fixing in position of the Christmas tree safely and with a play in all directions, independently of the structure of the ground at the location where the tree is put up, and even if the surface of the trunk is not uniform.

The solution to the problem is solved by the features of the first patent claim. In the subclaims, advantageous further developments of the inventive idea are indicated. For a better understanding of the invention refer to the drawings below.

FIG. 1 is a section through the Christmas tree stand according to the invention, comprising a fixing bell with the inserted Christmas tree and a filled up bellows;

FIG. 2: the stand as shown in FIG. 1, however without the Christmas tree and with the bellows being empty;

FIG. 3: a Christmas tree stand with two fixing bells;

FIG. 4: a plan view of FIG. 2;

FIG. 5: an illustration of the upper and lower fixing elements, respectively, in the open and closed condition;

FIG. 6: a lateral view of an upper fixing element with fixing Screw;

FIG. 7: a plan view of FIG. 6;

FIG. 8: a Christmas tree stand with two fixing bells and two bellows;

FIG. 9: a Christmas tree stand of small overall height;

FIG. 10: a fixing element; lateral view;

FIG. 11: Section A–B of FIG. 10.

DETAILED DESCRIPTION OF THE INVENTION

Figure 1:
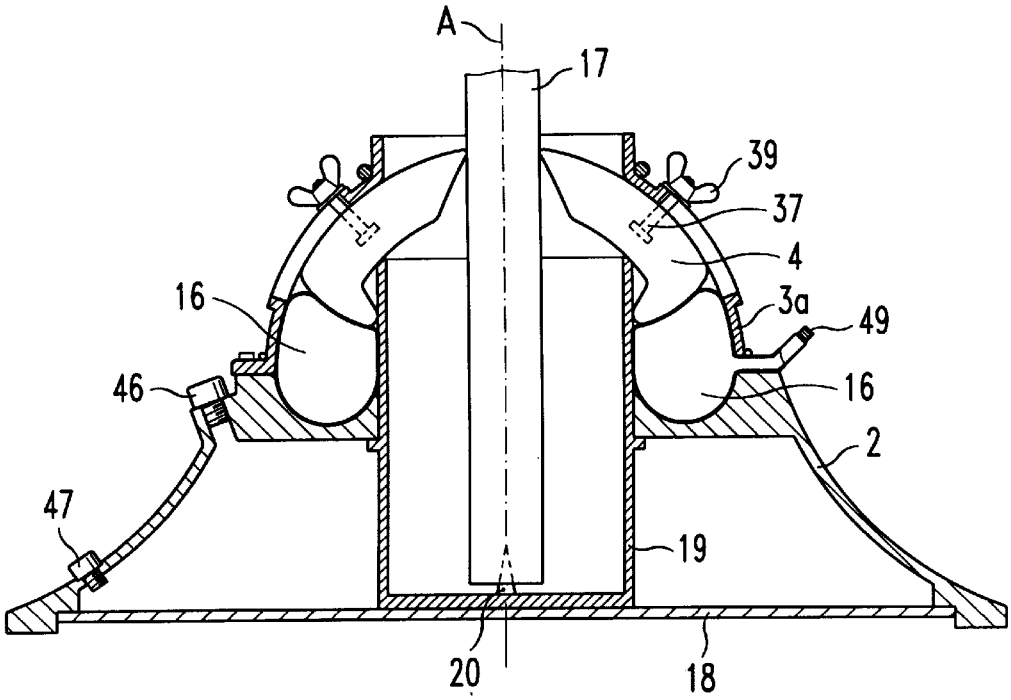
Figure 2:
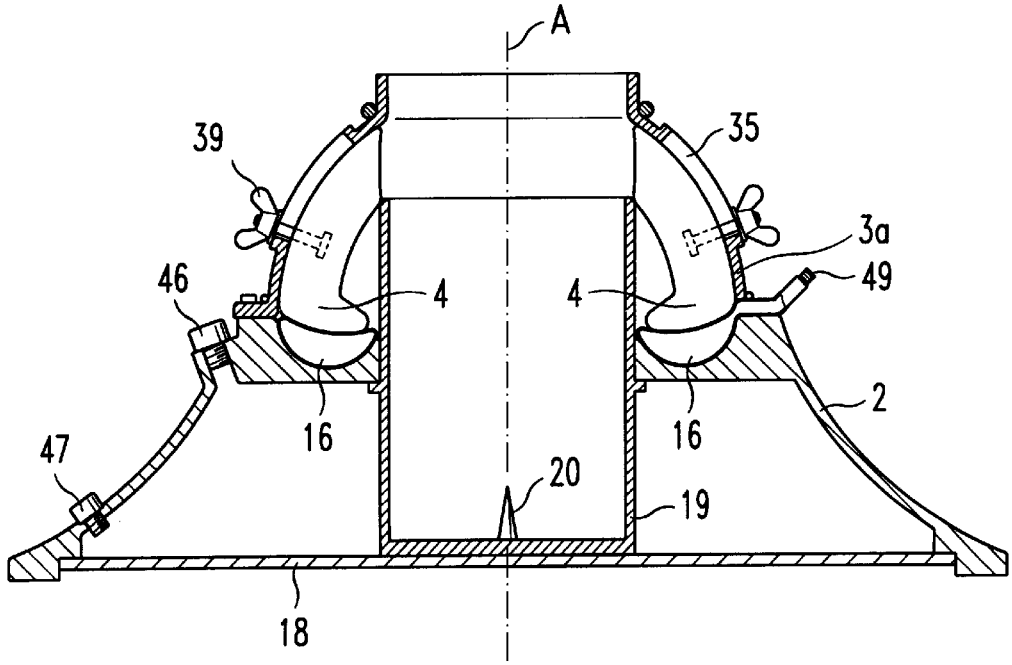

According to FIGS. 1 and 2, the fixing elements 4 are disposed in mobile fashion about a vertical axis A. In the case of a horizontal-vertical movement the ends thereof are subjected to the action of the annular bellows 16 in the fixing bell 3*a*, which is open at the top, in an arcuate manner such that they initially adapt to the bellows 16 which is increasing in volume. As the bellows 16 is then filled further the fixing elements 4 are displaced into the expansion direction of the expanding bellows 16. This displacement involves a movement of the fixing elements 4 in a horizontal-vertical manner, in the direction of the vertical axis A. This movement takes place with the fixing elements 4 abutting the inner side of the fixing bell 3*a*, with individual or all of the fixing elements 4 adjusting to the guiding slots 35 formed in the fixing bell 3*a*. In the course of movement, the individual fixing elements 4 first abut the circumferentail surface of the Christmas tree 17 in a manner such that no or only an insignificant holding force is exerted on these. It is irrelevant in this connection how the circumferential surface to be clamped is contoured as the individual fixing elements 4 adapt thereto.

If the pressure in the bellows 16 is increased, the individual fixing elements 4 are urged—in accordance with the pressure increase in the bellows 16—both against the inner surface of the fixing bell 3*a* and against the circumferential surface of the Christmas tree, with the individual fixing elements 4 not moving or only to an insignificant extent. This has the advantage that the Christmas tree to be fixed in position is not urged away from its predetermined vertical position. If the pressure in the bellows 16 has been increased only slightly or insignificantly the Christmas tree to be fixed in position can still be adjusted for its vertical position as the holding forces occurring at the friction surface between the fixing elements 4 and the fixing bell 3*a* can be overcome comparatively easily, corresponding to the pressure exerted. When effecting adjustment in this way the individual fixing elements 4 remain abutted to the circumferential surface of the Christmas tree in largely unchanged form. Orienting of the trunk is done by displacing the individual fixing elements 4 on the fixing bell 3*a*. The desired position of the Christmas tree is ensured simply by inclining the trunk, the centering mandrel 20 attached to the stand bottom 18 serving as a fixing point. Depending on requirement, the individual fixing elements 4 either are advanced by the bellows 16 in the direction of the axis A or pushed back by the forces applied to the trunk in the direction of the bellows 16. During the orienting process all of the fixing elements 4 remain abutted to the trunk to be fixed in position. As the pressure in the bellows 16 is increased further the final fixing and locking of the Christmas tree 17 in position takes place, with the individual fixing elements 4 abutting both the object to be locked in position and the inner surface of the fixing bell 3*a*, and with the Christmas tree 17 being held firm against any displacement. For filling the bellows 16 with a pressure medium a supply line 49, closed by a valve, is provided.

This automatically compensates for any deformation of the fixed Christmas tree 17 in the abutting region of the fixing elements 4, thereby safeguarding a secure and permanent fixation. Owing to the fixing screws 37, provided in at least three of the fixing elements 4 according to FIGS. 6 and 7 and extending through the guiding slots 35 of the fixing bell 3*a* and onto which a suitable locking nut 39 with a washer is screwed, the Christmas tree to be held tight can be protected in addition by tightening the locking nuts 39 mechanically and permanently on the lateral rims of the guiding slots 35. This additional mechanical protection increases the standing stability of the Christmas tree considerably and permanently. Moreover, the fixing screws 37 located externally of the fixing bell 3*a* may be easily manipulated and advantageously serve, on releasing the Christmas tree, to loosen the fixing elements 4 after the bellows 16 has been emptied and to set them back in the direction of the bellows 16.

Figure 4:
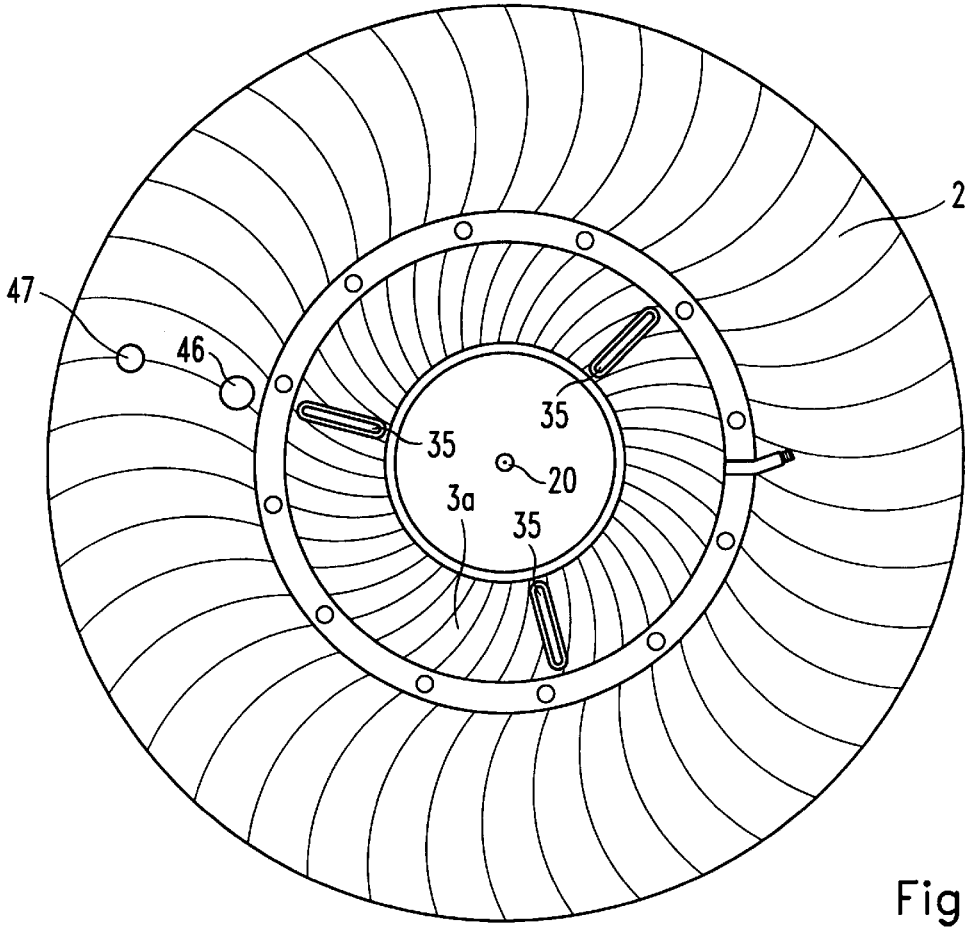

In order to release the Christmas tree 17, first the fixing screws 37 are loosened, and the valve provided on the supply line 49 is actuated in order to allow the pressure medium to flow out. Through slightly moving the Christmas tree the individual fixing elements 4 of both the fixing bell 3*a* and the Christmas tree 17 are loosened to release the same. In FIG. 4 a feasible arrangement of the guiding slots 35 in the fixing bell 3*a* as well as the location of the filling and discharge openings 46 respectively 47 for supplying the stand base 2 with water can be seen.

According to a further development of the inventive idea elastic elements 48 are inserted between the fixing elements 4 in FIG. 5, ensuring an even distribution thereof in the opened condition (bottom left of FIG. 5) and supporting retraction thereof from the fixed position of the Christmas tree 17 after discharge of the pressure medium. The elastic elements 48, according to FIGS. 6 and 7, may be inserted, respectively, into a lateral recess 54 of two adjacent fixing elements 4 or surround the same in part.

Figure 3:
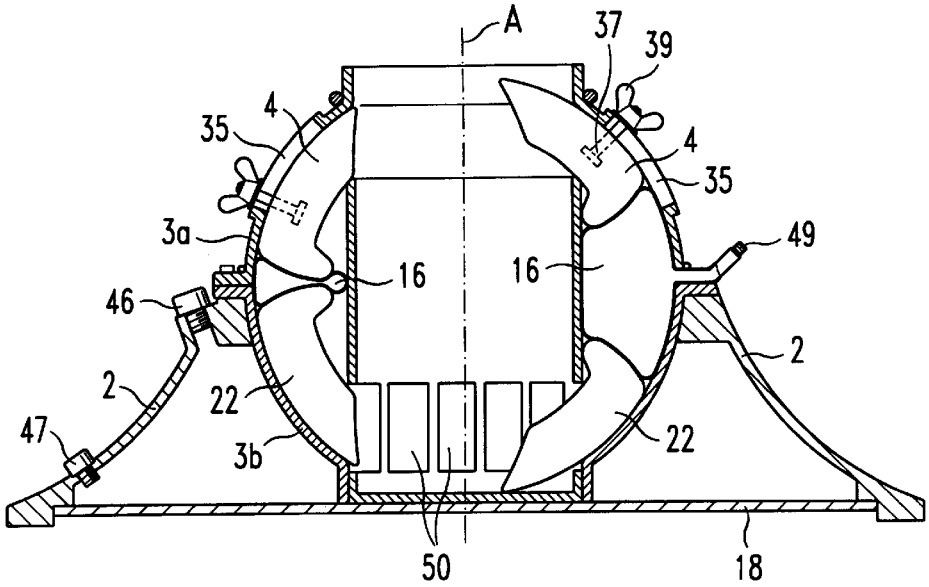

A further embodiment within the scope of the inventive idea is indicated in FIG. 3, the lower end of the trunk of the Christmas tree 17 not being oriented and fixed here by means of a fixing mandrel but by a sequence of further fixing elements 22 installed in mirror-inverted fashion in the lower fixing bell 3*b*, the ends of said fixing elements 22 equally being subjected to the action of the joint bellows 16; they contact the trunk through the slots 50 provided in the receiving portion 19. On the left-hand side of FIG. 3 the provision of the fixing elements 4 respectively 22 with the bellows 16 being empty, and on the right-hand side the position thereof with the Christmas tree 17 in the fixed position being shown. After insertion of the Christmas tree 17 into the receiving portion 19 the fixing elements 4 and 22 are adjusted—applying little pressure—until making contact with the trunk. The respective movements ensue in opposite directions. As the pressure in the bellows 16 is increased further, the Christmas tree is finally fixed and locked in position, with the individual fixing elements 4 respectively 22 abutting both the object to be fixed and the inner surface of the fixing bell 3*a* and 3*b*, the Christmas tree being held firm. against any displacement. Also a possible deformation of the fixed Christmas tree in the abutting area of the fixing elements 4 respectively 22 is automatically compensated thereby. This ensures a safe and permanent fixation. Advantageously, the lower fixing elements 22 may equally be provided with elastic elements 48.

In the separation plane between the fixing bell 3*a* and the stand base 2 (FIG. 1) respectively of the fixing bell 3*b* (FIG. 3) the supply line 49 for the bellows 16 is guided.

Figure 8:
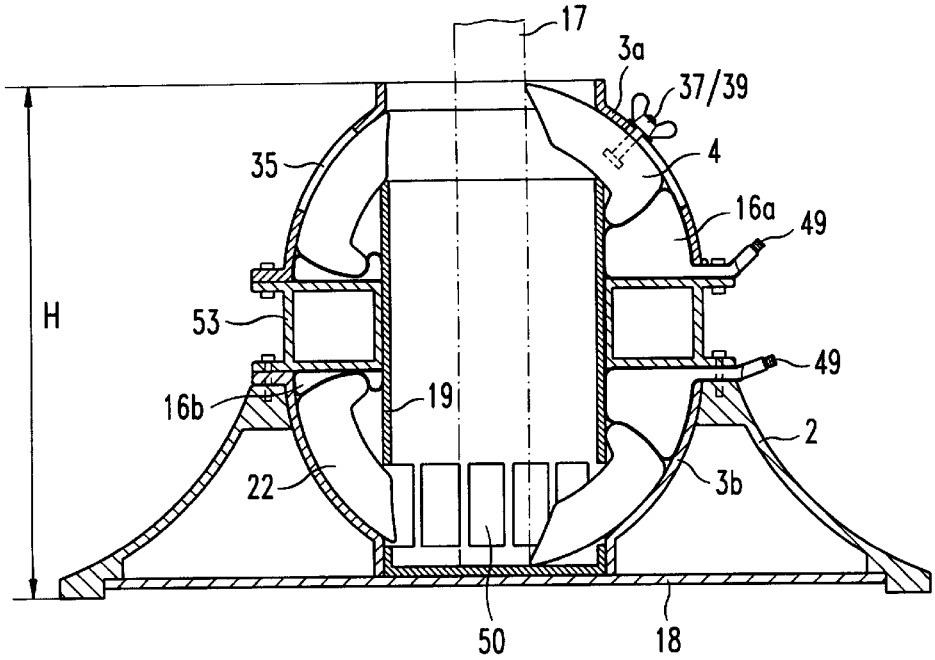

For use with very high Christmas trees a tree stand with two separate fixing systems as shown in FIG. 8 is provided as a further development of the inventive idea. This structure comprises an upper row of fixing elements 4 in the fixing bell 3*a* acted upon by the first bellows 16*a* and a lower row of fixing elements 22 in the fixing bell 3*b* acted upon by the second bellows 16*b*. The overall height H of the Christmas tree stand moreover is determined by the intermediate piece 53 inserted between the two fixing bells 3*a* and 3*b* and supported by the stand base 2, the receiving portion 19 mounted in the interior being extended by the height of the intermediate piece 53. Each of the bellows 16*a*, 16*b* is connected to a pressure medium source by means of a separate supply line 49 via a valve which is not shown. The further features of this embodiment are in accordance with the design of FIG. 3. Thus, in FIG. 8, left-hand side, there also is shown the position of the fixing elements 4 respectively 22 with the bellows 16*a*, 16*b* being empty, and on the right-hand side with the Christmas tree 17 being clamped.

The structure according to FIG. 8 is particularly suited for high Christmas trees that are to be put up outside. The separate, mutually independent association of a bellows 16*a* or 16*b* to each of the two fixing systems also permits the utilization of high clamping moments. In combination with a large support surface of the stand base 2 the Christmas tree stands thus have a high stability and are able to also safely stand outside. The stability may be increased further by using a metal for the stand base 2 as well as for the bottom plate 18. A further advantage with the embodiment according to FIG. 8 resides in the separate adjustment of the lower and of the upper fixing elements 4 and 22, respectively. Thus, the method employed with Christmas tree stands according to FIG. 3 can be clearly improved and accelerated when adjusting and fixing the tree in position by means of a controlled, mutually independent actuation of the fixing elements 4 and 22, respectively.

The inventive idea can also be successfully made use of in a different, particularly simple design of the Christmas tree stand that has a small overall height. The housing according to FIG. 9, to this end, is designed as a one-part moulding 103 the upper portion 102 of which directly terminates in the base portion 101. This upper portion 102 does not form a complete hemisphere but a sphere section having a sector angle of less than 180°, which decisively contributes to a reduction of the overall height. On the inside of the moulding 103 an annular cup 105 is provided, serving as a guiding means for the trunk of the Christmas tree 17 and as an abutment for the bellows 16. Into the annular cup 105 the receiving sleeve 106 is fitted, which supports the Christmas tree 17 and is used as a water reservoir. At the bottom of the receiving sleeve 106 the centering mandrel 20 is located, which serves the same purpose as the design according to FIGS. 1 and 2.

Figure 9:
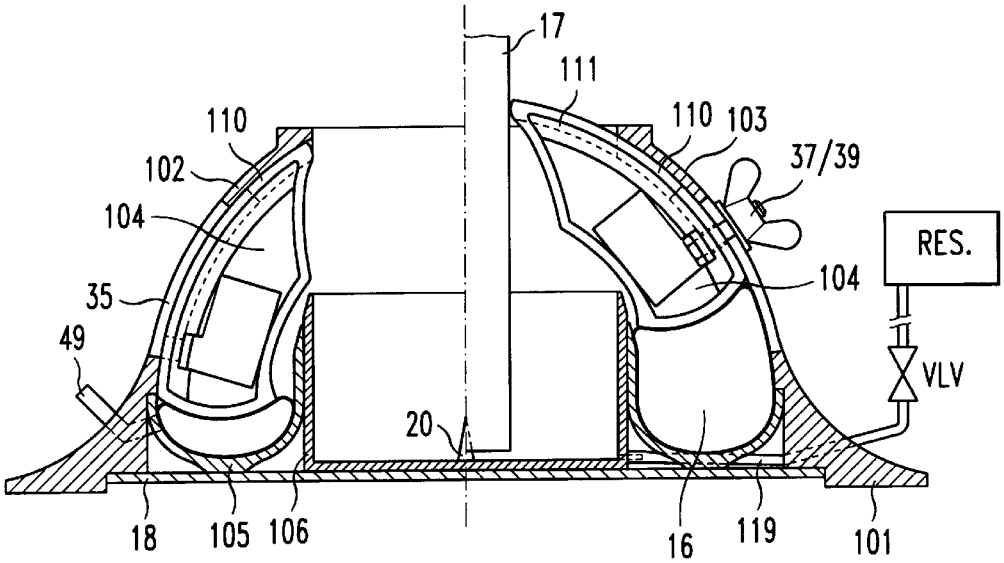

On the left-hand side of FIG. 9 the Christmas tree stand is shown with the bellows 16 being empty, whilst the right-hand side shows the stand with the inserted Christmas tree 17. On the inside of the upper portion 102 the arcuately guided fixing elements 104 are provided, which, at their ends, are acted upon by a bellows 16, like with the embodiments already described. The lateral guiding of the fixing elements 104 is effected by means of the ribs 110, which engage correspondingly formed grooves 111 of the fixing elements 104. Like in the case of the already described constructions of the Christmas tree stand, there equally are provided guiding slots 35 in the upper portion 102 according to FIG. 9, with the aid of which at least three fixing elements 104 lock the Christmas tree 17 in its inserted position (right-hand side of FIG. 9) by means of a fixing screw 37 and a locking nut 39. To the bottom side of the base portion 101 of the Christmas tree stand according to FIG. 9 a bottom plate 18 is attached, on which both the annular cup 105 and the receiving sleeve 106 rest. Securing is effected by means of screwing, but it can also be carried out by means of plug connections as there are no tightness requirements. The bellows 16 is connected to a pressure medium reservoir via a supply line 49 and a control means, which is not shown.

In order to be able to keep the height of the Christmas tree stand small, the construction according to FIG. 9, in contrast to the previously described embodiments, only comprises one access to the water reservoir accommodated in the receiving sleeve 106. At the other end of this pipe connection 119 a feeding reservoir disposed at the same level and externally of the Christmas tree may be located, ensuring a supply in accordance with the principle of communicating vessels. The receiving sleeve 106 may also be filled from an external reservoir mounted at any level desired, in which water is stored, using the pressure of a partly dissolved gas, and supplied as required by opening a valve disposed in the interior of the pipe connection 119 (syphon). The two techniques mentioned in connection with the water supply to the Christmas tree are known per se. The pipe connection 119 is located in the area of the Christmas tree stand, in the vicinity of the bottom plate 18, and is guided along the bottom side of the annular cup 105 as well as through the lateral wall of the moulding 103.

As pressure medium for filling the bellows 16, 16*a* and 16*b* air or a non-combustible gas, such as nitrogen, may be used for all embodiments. On particularly hazardous premises also an inert gas, such as helium, may be used. Control of the filling pressure, indicated by a manometer, is effected manually with the aid of a simple valve.

In special cases a liquid may be used as pressure medium, which is in communication with an externally provided pressure medium reservoir via the supply line 49 and which can equally be controlled in response to the pressure. This control may also be carried out with the aid of a feed-back control means set to a predetermined pressure. Such a system can advantageously be employed particularly with Christmas tree stands according to FIG. 9 which are put up in the open air or on large premises such as halls or churches and do not require any maintenence.

Figure 10:
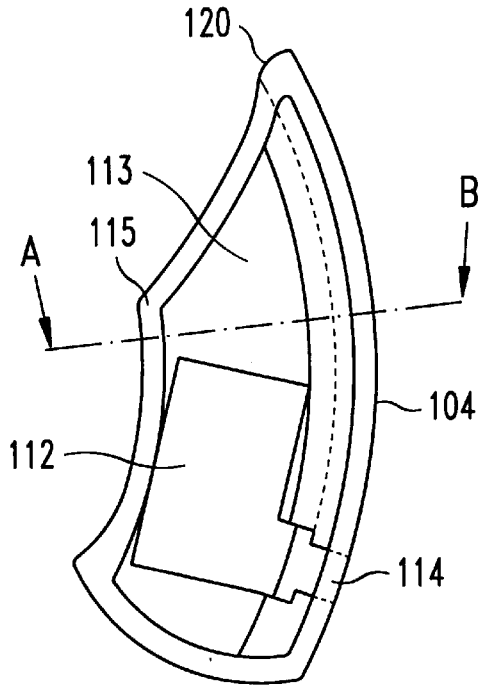
Figure 11:
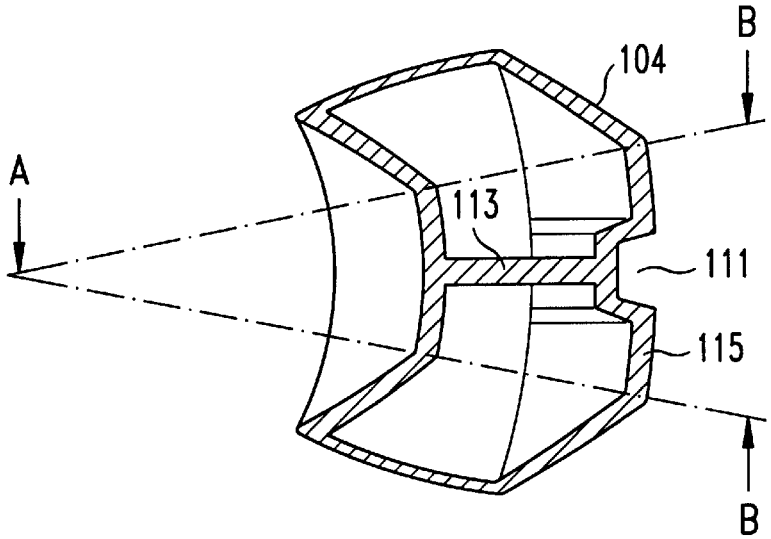

In the various embodiments of the Christmas tree stand fixing elements 104 for installation in the fixing bell 3*a* or in the upper portion 102 of the moulding 103 may be provided, comprising, according to FIGS. 10 and 11, a surrounding rim 115 on the circumference which is intersected by a groove 111 on the side facing the inner surface of the spherical section, which groove 111 engages a rib 110 (FIG. 9) extending in the adjustment direction, respectively. For stabilization, a stiffening 113 is provided in the plane of symmetry, the break-through 112 of which provides access to the bore 114 for the fixing screw 37. The rim 115 has a convexly curved contact surface 120 for making a definite contact with the trunk of the Christmas tree also if the latter has an irregular shape and/or a cracked bark.

The lower fixing elements 22 indicated in FIGS. 3 and 8, too, may be manufactured in a form similar to element 104, yet without the bore 114. The recesses formed on each side of the stiffening 113 and defined by the surrounding rim 115 are extremely well suited for accomodating the elastic elements 48. These elements ensure a uniform distance between the fixing elements, particularly if these are not guided in ribs 110.

The components of the various embodiments of the Christmas tree stand according to the invention permit both the manufacture as a pressure casting and as an injection moulded part from a plastics material suited for use in living quarters or outside. The choice of the production method depends on the number of items to be expected. A further criterion for the selection of the work material is the stability of the Christmas tree when standing. For this reason, it is advantageous with large trees to use metal for the stand base 2 and the bottom plate 18, respectively, for instance an aluminium alloy.

What is claimed is:

1. A Christmas tree stand with a housing comprising a hemispherical upper portion with an opening for receiving a Christmas tree, a base portion, a fixing bell, and a stand base connected thereto, and equipped with arcuately shaped fixing elements arranged in annular form and adapting to the shape of the upper portion, and being slidably guided on an inner surface thereof, and which, together with a holding element, maintain the Christmas tree, characterized in that the fixing elements are movable by annular, expanding bellows that may be filled with a pressure medium and which presses against ends of the fixing elements.

2. Christmas tree stand according to claim 1, characterized in that between the stand base and the fixing bell a further hemispherical fixing bell is arranged, in which a second fixing system with similar fixing elements is provided, the ends of which may equally be acted upon by the bellows.

3. Christmas tree stand according to claim 2, characterized in that two systems are mutually separated by an intermediate piece installed between the fixing bells, and in that the fixing elements may be acted upon by associated bellows, respectively.

4. Christmas tree stand according to claim 2, characterized in that slots are provided for guiding the fixing elements in a lower region of a receiving portion.

5. Christmas tree stand according to claim 2, characterized in that the stand base is made of metal.

6. Christmas tree stand according to claim 1, characterized in that with the fixing bell, at the opening and at a base-end opening, a stiffening in the form of a metal strip or a metal ring is provided, respectively.

7. Christmas tree stand according to claim 1, characterized in that the holding element is additionally provided with a cylindrical receiving portion extending into the fixing bell and serving as an abutment for each of the bellows.

8. Christmas tree stand according to claim 1, characterized in that the stand base is designed as a receiving vessel for water, having corresponding filling and discharge means.

9. Christmas tree stand according to claim 1, characterized in that the housing is designed as a one-part moulding composed of the upper portion formed as a spherical section with a sector angle of less than 180° and of adjoining base portion.

10. Christmas tree stand according to claim 9, characterized in that in the moulding an annular cup and a receiving sleeve to support the Christmas tree are installed, which are held by a bottom plate attached to the bottom side of the base portion.

11. Christmas tree stand according to claim 9, characterized in that a receiving sleeve serves as a water reservoir and is connected to a supply line going through said moulding.

12. Christmas tree stand according to claim 11, characterized in that the supply line is connected to a reservoir disposed externally and at the same level as the receiving sleeve.

13. Christmas tree stand according to claim 11, characterized in that the supply line is connected to a reservoir disposed externally and at any level desired, from which, upon the actuation of a valve, water subjected to the pressure of a propellant gas flows into the receiving sleeve.

14. Christmas tree stand according to claim 9, characterized in that ribs disposed at the inside of the upper portion serve as guiding means for the fixing elements provided with matching grooves.

15. Christmas tree stand according to claim 9, characterized in that the fixing elements are in the form of sectors and have a surrounding rim stabilized by a stiffening, at the opposite ends of which the contact surface for the trunk of the Christmas tree and an end face for the bellows is located, and in that the stiffening includes a breakthrough communicating with a bore for a fixing screw.

16. Christmas tree stand according to claim 9, characterized in that a bottom plate is made of metal.

17. Christmas tree stand according to claim 1, characterized in that as the holding element a centering mandrel is provided.

18. Christmas tree stand according to claim 1, characterized in that for guiding and fixing the fixing elements in fixing bell or in the upper portion guiding slots are provided, serving as a passageway for fixing screws.

19. Christmas tree stand according to claim 18, characterized in that at least three of the fixing elements can be permanently fixed on the fixing bell or on the upper portion by means of a fixing screw and a locking nut.

20. Christmas tree stand according to claim 1, characterized in that for a lateral mutual orientation of the fixing elements, elastic elements are arranged between the fixing elements.

21. Christmas tree stand according to claim 1, characterized in that as a pressure medium, air or a non-combustible gas is provided, which may be filled into the bellows via a valve, preferably a check valve.

22. Christmas tree stand according to claim 1, characterized in that as pressure medium, a liquid, preferably a pressurized oil having a high fire point is provided, which is connected to a pressure reservoir via a valve control.

* * * * *